United States Patent [19]

Williams

[11] Patent Number: 5,052,681

[45] Date of Patent: Oct. 1, 1991

[54] UPPER EXTREMITY REHABILITATION DEVICE

[76] Inventor: George R. Williams, 504 Country Side Trail, Edmond, Okla. 73034

[21] Appl. No.: 574,491

[22] Filed: Aug. 27, 1990

Related U.S. Application Data

[63] Continuation of Ser. No. 448,557, Dec. 11, 1989, abandoned.

[51] Int. Cl.[5] ..... A63B 21/04

[52] U.S. Cl. ..... 272/136; 272/67

[58] Field of Search ..... 272/67, 68, 133, 135–143, 272/900

[56] References Cited

U.S. PATENT DOCUMENTS

| | | | |
|---|---|---|---|
| 3,197,204 | 7/1965 | Holkesvick et al. | 272/133 |
| 3,614,098 | 10/1971 | Carr | 272/133 |
| 4,026,549 | 5/1977 | Gunn | 272/142 X |
| 4,251,071 | 2/1981 | Norton | 272/68 X |
| 4,294,446 | 10/1981 | Moore | 272/133 |
| 4,328,964 | 5/1982 | Walls | 272/136 |
| 4,505,476 | 3/1985 | Rubin | 272/DIG. 4 X |
| 4,557,480 | 12/1985 | Dudley | 272/133 |
| 4,565,367 | 1/1986 | Kaiser | 272/142 X |
| 4,635,930 | 1/1987 | Cormier | 272/DIG. 4 X |
| 4,733,862 | 3/1988 | Miller | 272/136 X |
| 4,779,867 | 10/1988 | Hinds | 272/142 X |
| 4,793,609 | 12/1988 | Coutts et al. | 272/142 X |
| 4,834,719 | 5/1989 | Arenas . | |

FOREIGN PATENT DOCUMENTS 1802516 5/1970 Fed. Rep. of Germany ..... 272/142

OTHER PUBLICATIONS

Advertisement for the "Finger Platter", date unknown.

*Primary Examiner*—Robert Bahr

[57] ABSTRACT

A hand held upper extremity rehabilitation and exercise device comprising two interconnecting pieces in the shape of a dowel or rectangle of which contains corresponding apertures in graded dimensions receiving corresponding graded flexible tubing ends in and through the device and where one piece slides distally upon a static piece decreasing the aperture space and subsequently initiating 3 point contact of the tubings within the device when tension of the tubings are increased through exercise and range of motion by the user. The device utilizes the principle inherent to elastic compression where the resistance of the tubing during exercise exerts the force of same upon the perimeters of the sliding part moving the piece distally parallel to the line of pull resulting in 3 point contact within the device where compression is always greater than the disconnecting force without the device. The device is most practical in upper extremity rehabilitation and athletic training where specific graded various diameters of flexible tubing can be utilized individually or simultaneously to enhance clinical and non clinical strengthening programs throughout all planes of joint motion to the upper extremities.

5 Claims, 3 Drawing Sheets

UPPER EXTREMITY REHABILITATION DEVICE

This application is a continuation of application Ser. No. 07/448,557, filed Dec. 11, 1989, now abandoned.

This invention relates to physical rehabilitation and athletic training of the upper extremities in the manner of strengthening and range of motion.

BACKGROUND OF THE INVENTION

1. Field of the invention

This invention may be used by clinical and non clinical personel for the purpose of strengthening and range of motion activities where specific lines of pull and graded resistance are important to achieving goals in rehabilitation or athletic training. More specifically the present invention relates to a quick indirect connect-/disconnect multiple graded flexible tubing clamp. Further more, this device is particularly adapted to providing comfort while engaging increasing resistance while operating the device through range of motion activities without visable abrasion or wear to the tubing ends.

Professional ball players, sports enthusiasts, patients in the upper extremity rehabilitation settings and patients requiring home programs may benefit from using this device. Virtually every plane of motion of all joints above the fingers may benefit from said device. Modified handles allow specific finger function to include lateral pinch, opposition pinch, and three jaw chuck.

2. Description of prior art

Prior patents generally disclose various methods of permanently crimping or clamping a single flexible tube with the exception of the Arenas quick connect-disconnect tubing adapter who utilized an ingenious method for clamping a tube end in a sterile environment incorporating a serrated collet and an eliptical interplay to allow the joining of another tube within, which may be reversed is desired.

Another commercial example is that of an expansion piece cone or cylinder shaped engaged at a tubing end and thus preventing escape of the tubing end through the aperature of a handle.

This invention differs from prior patents and commercially available devices in that said invention will capture any number of tubing simultaneously to maximum resistance of the user by a series of graded aperatures incorporating three point contact within the device. The tube(s) held within their confines by the inherent resistance of the tube(s) upon itself as well, as elaborated on in the preceeding discussion. As we demonstrate the ratio for Clamping always being greater than the resistance of the pull. No other device is available which will allow therapists and trainers to adjust the resistance of flexible tubes in a quick connect/disconnect handle clamp.

This invention is distinctive over the described prior art devices in that it is not limited to one tube resistance. It is not an adapter as with Arena's invention, it is a multiple flexible tube quick connect-disconnect handle clamp for grading resistance for strengthening. The mechanism involved being an indirect three point contact clamp engaged completely and indirectly by the inherent act of exercise.

SUMMARY OF THE INVENTION

One embodiment comprises two rectangular wooden maple pieces, one piece free to slide proximally and distally upon a dowel of predetermined size which extends and is bolted on a proximal/handle side and affixed distally to the terminal portion of the static piece by a centrally located pan head screw. The arrangement allows free sliding of the central rectangular piece which contains graded multiple apertures which when in perspective proximal alignment, allows insertion or release of corresponding diameters of graded flexible tubes. The tubes being affixed to a door or physical rehabilitation device allows the patient the comfort of a hand held device which when engaged (pulled) will cause the graded flexible tubing to exert the resistance of the pull on the boarder of any or all of the aperture perimeters engaging an indirect or passive slide effect which in turn produces three point contact within the device thus holding the flexible tubing in a fixed position while exercising. Releasing of the resistance correspondingly releases the tubing. Clamping occurs when tubing is stretched at 90 degrees distally to its position in the device. A second embodiment comprises two interlocking pieces in the form of a dowel varying somewhat in concept by the addition of an active spring loaded component which maintains the position of the tubing in repose. Full clamping returns when tubing is stretched at 90 degrees to its position in the device. Furthermore, the 2nd embodiment contains a triallity of graded apertures, three in the embodiment, which are in a state of continual spring loaded engagement, the respective holes and loading of tubing through same being possible only by pushing the slide proximally (towards handle side) with the heal of ones hand and placing the respective tubing in an or all of the apertures. The slide is held in longitudinal alignment by two rods which are secured within the slide portion and may glide within the respective slightly larger bores in the proximal static piece. The slide is held in further alignment and appropriate repose by a stop pin and slot. The dowel allows interchangable handles to accomplish multiple goals in upper extremity rehabilitation.

The principal objects of this invention are to provide a manner in which patients who have endured surgery or other neuromuscular skeletal problems may participate in correction of improper muscle tone and joint mobility of the shoulder, elbow, wrist, and fingers and in strengthening in otherwise normal individuals throughout the arc of joint range of motion.

DESCRIPTION OF THE PREFERRED EMBODIMENTS

Figure 1:
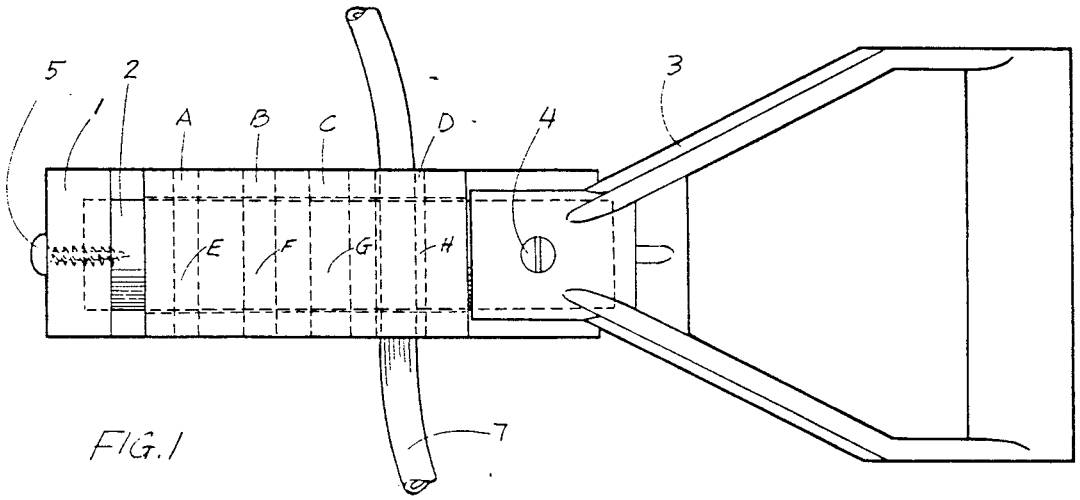
FIG. 1 is a top view of the passive slide clamp handle.

Like characters of reference designate like parts in those figures of the drawings in which they occur. In the drawings:

FIG. 1 reveals a commercially made handle 3 which incorporates a dowel or dowel like structure 2 composed of wood in this instance or of metal, plastic and the like which is affixed distally by a pan head lag screw 5 and proximally by a bolt and pressure nut component 4 allowing stability of the dowel 2 allowing a freedom of movement to the slide 6 or rectangular wooded piece containing gradually increasing diameters in triality of apertures A through H which pair up in proximal slide placement 6 allowing insertion of corresponding approximating diameters of flexible tubing which are loosly fitting in their respective apertures and become clamped when tension is produced in the length of tubing when the line of pull is distal to and perpendicular to the fixed position of same within the device which normally would extend out and fix to a door or physical therapy device as described. The number of tubing engaged in the device are limited to the number of corresponding apertures where in FIG. 1 AEA may contain a graded tubing exerting an average of 5 pounds throughout an arc of joint motion and if engaged simultaneously with the tubing shown 7 would increase the average resistance to approximately 15 pounds throughout the arc of joint motion.

Figure 2:
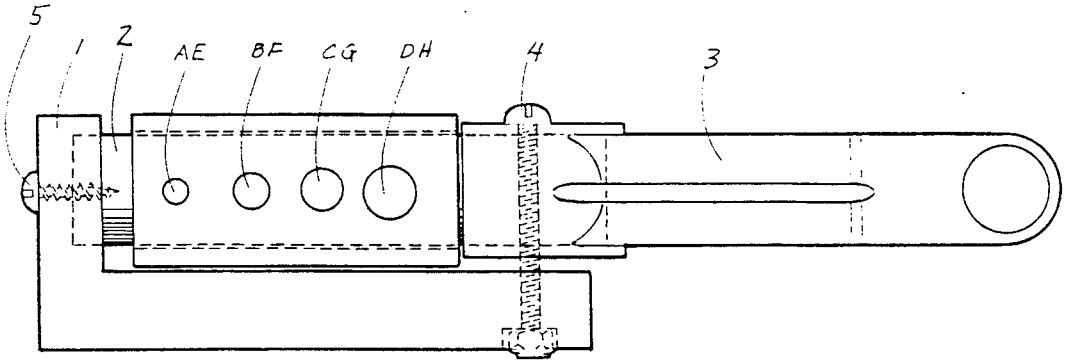
FIG. 2 is a side elevational view thereof.

If FIG. 2 we observe the slide in the same position without tubing indicating that tubing is fitted from either side, into and through the plurality of outside apertures as in FIG. 1 A, B, C, D. The slide in repose rests against the handle rim 3 which is connected to the dowel and extends to the static body 1 by the bolt and pressure nut 4 as in FIG. 1 and FIG. 2 then completion distally by a lag screw 5 encouraging proper compression by drawing the dowel into the bore in the static body 1 to accomodate same. The rectangular piece 6 is square from a distal perspective and is held in alignment by its tracking on the static body. The 3 point compression of the tubing actively holds same in position when one terminal end is stretched distally perpendicular to its position with the device. The outside rims of A through D are beveled to prevent damage and wear to the tubing. As tubing is stretched in this manner the slide is influenced distally reducing the alignment of the holes until the slide 6 meets the distal portion of the static body. The ratio for release is continually less than the stable 3 point compression acting on the tube when engaged.

Figure 3:
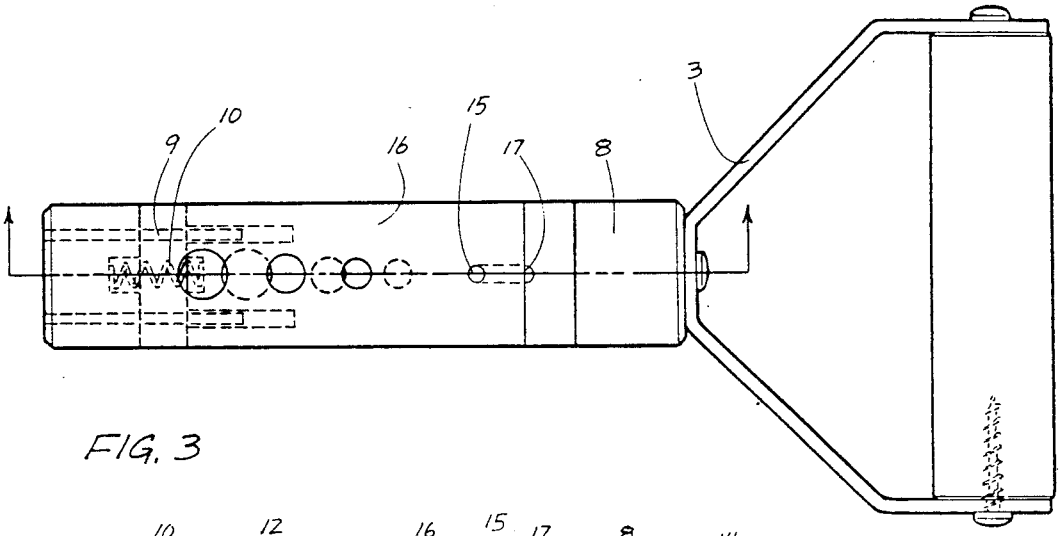
FIG. 3 is a top view of the preferred embodiment of the passive or passive active clamp handle.

FIG. 3 comprises basically the same in concept but with a compression spring 10 which prevents unintentional release of the tubing while not engaging resistance of the tubing as described previously. The design has varied by utilizing a stop pin 15 and a sagital slot 17 to prevent lateral structural malalignment and holds the slide in proper perspective in conjunction with the plurality of longitudinal pins 9 which are fixed in the distal end of the slide and which are loosely fitting in the corresponding bore 11 of the static body 8 allowing controlled proximal and distal tracting. The slide 16 is held in an engaged position indicated by the narrowed opening of the apertures which then require the therapist, trainer, or patient to push the distal end of the slide 9 with one palm bracing the handle against a receptive surface usually the abdomen and with the other hand insert the free ends of the appropriate tubing as described into and through their respective apertures. Release of the distal slide produces a spring loaded compression sufficient to hold tubing in position as described until the device is actively engaged by the user. The handle 3 is a required component of the device though may be altered and/or interchanged to achieve more specific goals in hand intrinsic and extrinsic musculature by design.

Figure 4:
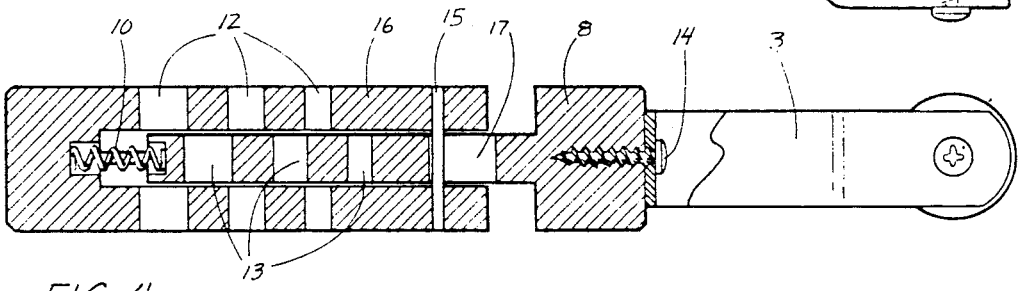
FIG. 4 is a side view thereof.

FIG. 4 comprises the same components in a side view to better illustrate the alignment of the apertures 12 and 13 in a spring loaded position.

Figure 5:
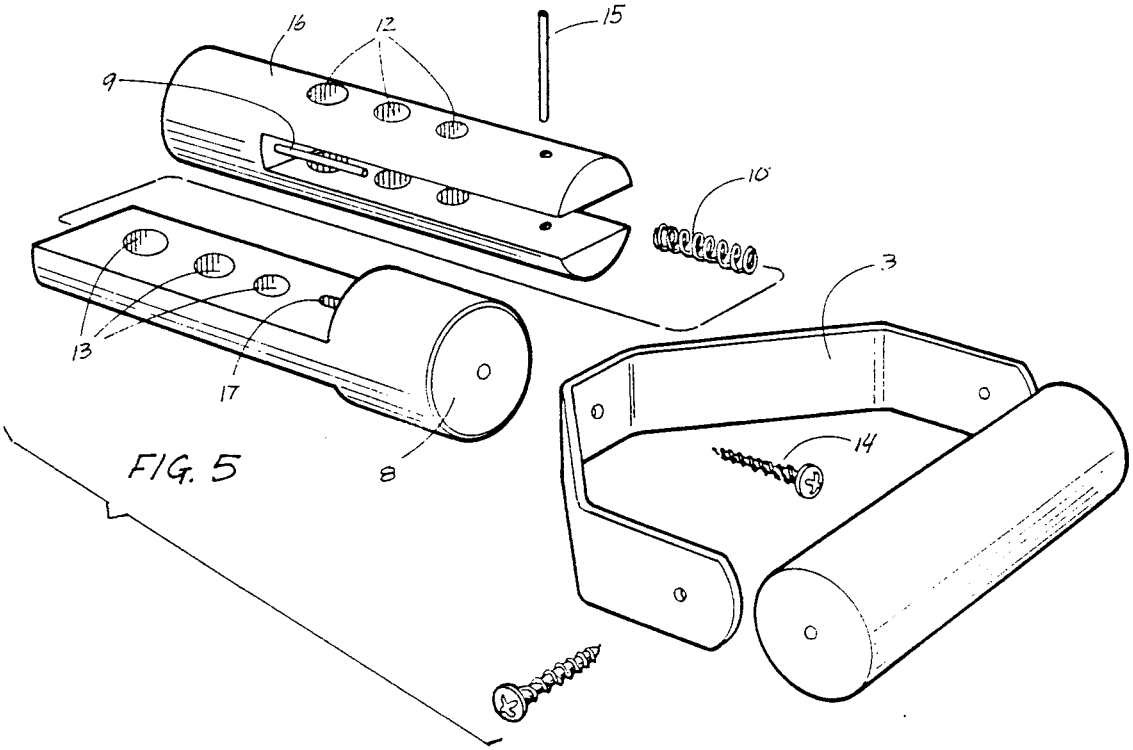
FIG. 5 is a perspective view of the second embodiment.
Figure 6:
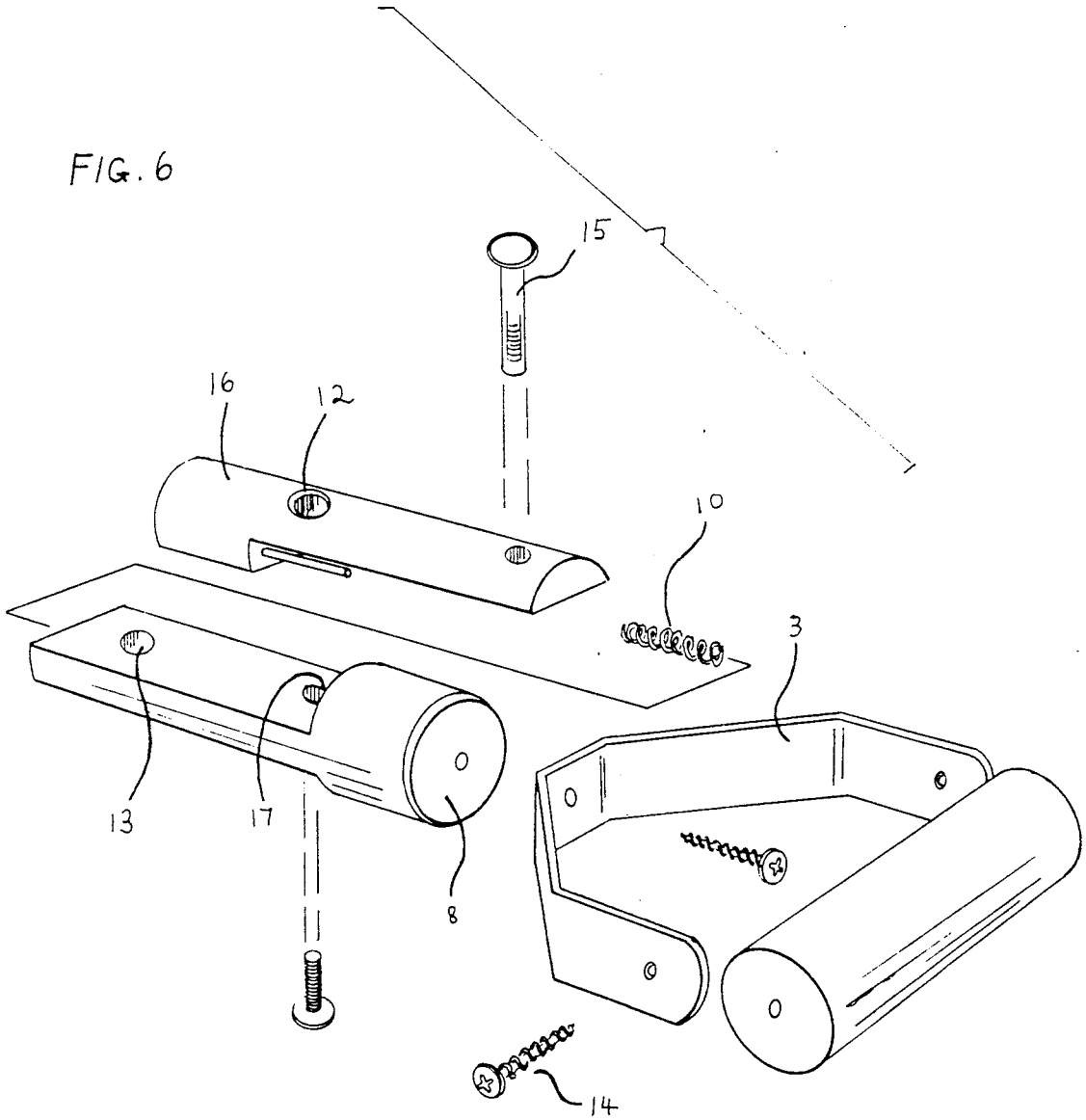

FIG. 5 comprises a perspective cylinder illustration where the handle is obviously lacking for the purpose of evaluating the alternatives for multiple handle attachments.

In summary, the tube handle will safely and quickly attach multiple graded (in size and resistance) flexible tubes for the purpose of exercise in any or all planes of joint motion to the upper extremities when the other ends of the tubes are stabilized about a door or physical therapy device. The device may be beneficial to non clinical as well as clinic application where strengthening throughout the arc of joint motion with substantially reduced joint compression and sustantially increased ease of application is desired.

Obviously the invention will undergo continual evolution and alterations without defeating its practability therefore I do not wish to be confined to the preferred embodiment shown in the drawings and described here in.

I claim:

1. A hand held and upper extremity rehabilitation device comprising:

a bifurcated member having two aligned branches, each branch having a series of aligned apertures increasing in diameter along the length of the member;

a central member having a series of apertures in alignment with and of a corresponding diameter to the apertures of the branches of the bifurcated member, said central member being of a size and shape as to permit slidable insertion of the central member between the branches of the bifurcated member such that the apertures of the central member and bifurcated member may be selectively aligned or askewed; and a length of flexible tubing having on one end means for attachment to a stationary structure, the flexible tubing being insertable into aligned apertures of the bifurcated and central members, whereby the bifurcated or central member may be grasped by the user and pulled against the tension created by the flexible member passing through selectively askewed apertures of the bifurcate and central members.

2. The hand held hand and upper extremity rehabilitation device of claim 1, wherein the diameter of the flexible tubing is such that here is no tension created when flexible member passes through aligned apertures of the bifurcated and central members.

3. The hand held upper extremity rehabilitation device of claim 2, further comprising a handle mounted on the central member.

4. The hand held and upper extremity rehabilitation device of claim 3, further comprising a screw for adjusting the aligned or askewed position of the apertures of the bifurcated and central members.

5. The hand held hand and upper extremity rehabilitation device of claim 4, further comprising a compression spring for biasing the apertures of the bifurcated and central members to an askewed position and preventing unintentional release of the flexible tubing.

* * * * *